US005907909A

United States Patent [19]

Autio

[11] Patent Number: 5,907,909

[45] Date of Patent: Jun. 1, 1999

[54] STEAM/CONDENSATE/WATER COUPLING FOR A CYLINDER IN A PAPER/BOARD MACHINE

[75] Inventor: Jukka Autio, Karstula, Finland

[73] Assignee: Valmet Corporation, Helsinki, Finland

[21] Appl. No.: 08/780,500

[22] Filed: Jan. 8, 1997

[30] Foreign Application Priority Data

Jan. 8, 1996 [FI] Finland ..... 960072

[51] Int. Cl.[6] ..... D06F 58/00

[52] U.S. Cl. ..... 34/125; 165/90

[58] Field of Search ..... 34/124, 125, 108; 165/89, 90

[56] References Cited

U.S. PATENT DOCUMENTS 5,230,169 7/1993 Jaatinen et al. ..... 34/124

*Primary Examiner*—Henry Bennett
*Assistant Examiner*—Malik N. Drake
*Attorney, Agent, or Firm*—Steinberg & Raskin, P.C.

[57] ABSTRACT

A coupling in connection with a paper/board machine, preferably a steam, condensate and/or water coupling. The coupling frame has an exhaust connection for condensate or water in an end thereof and includes an annular groove into which a piston is placed. One or more springs are placed between the end of the piston and the bottom of a respective spring socket in the coupling frame and act upon the piston. The frame includes fastening members for fixing the frame to a bearing housing of the cylinder or to a part connected therewith.

11 Claims, 6 Drawing Sheets

17a
1/6
20
21
22
23
SUPPLY OF STREAM
EXHAUST OF CONDENSATE
10

10
17a
20
21
EXHAUST OF CONDENSATE 17a
20
21
SUPPLY OF COMPRESSED AIR
P1
SUPPLY OF WATER
EXHAUST OF WATER
10

20
21a
21b
21c
30
27a1
26a1
24
25
L
R1
28b
28
25b
25a
F
J1
22
J2

STEAM/CONDENSATE/WATER COUPLING FOR A CYLINDER IN A PAPER/BOARD MACHINE

FIELD OF THE INVENTION

The present invention relates to a steam/condensate/water coupling for a cylinder in a paper/board machine. The present invention also relates to an arrangement for a drying cylinder in a paper/board machine.

BACKGROUND OF THE INVENTION

From the current assignee's Finnish Patent No. 90,100 (which corresponds to U.S. Pat. No. 5,230,169, incorporated by reference herein), a steam and condensate coupling in connection with a drying cylinder in a paper machine is known, by means of which coupling a pressure-tight joint is permitted between revolving cylinder parts and connected stationary parts. In the construction disclosed in Finnish Patent No. 90,100, a carbon seal is used and is fitted in an axially displaceable piston part. The piston part is further connected with an annular groove in a fixed support construction. These pieces are rotationally symmetric, and the steam and condensate pipes are passed into the drying cylinder through the central spaces in these pieces. The steam is passed through an inlet connection placed at the end of the steam and condensate coupling so that the steam is made to flow through perforations in the wall of the steam pipe into the interior of the steam pipe and further forward inside the steam pipe and into the cylinder. The condensate pipe is passed centrally in the steam pipe, and condensate and water may be removed through the condensate pipe. Both the steam pipe and the condensate pipe are stationary constructions, and they are supported in a stationary position in relation to the other constructions. The steam pipe and the condensate pipe are passed centrally through the hollow interior space in the cylinder shaft into the interior of the cylinder. In order that the steam is not discharged from the interior of the cylinder and in order that the central passing of the steam and condensate pipes can be permitted, the arrangement comprises the coupling construction described above around the steam and condensate pipes, in which connection the pressure of the steam is fitted to act upon the face of the piston part, and the seal connected with the piston part is pressed by means of the piston part against the end of the shaft or against a part connected with same so as to produce a tight joint. In order that the joint should be tight under all circumstances, there are springs between the piston part and the connected stationary frame. By means of the springs, a force is produced so as to press the seal against the end of the shaft also in the situations in which the pressure in the drying cylinder cannot act upon the piston part.

OBJECTS AND SUMMARY OF THE INVENTION

It is an object of the present invention to provide an improvement on the steam and condensate coupling described in Finnish Patent No, 90,100 above. Specifically, in the prior art construction of FI 90,100, the steam and condensate coupling comprises a frame construction in which there is a separate, so-called rotary support, in whose annular groove the piston part is arranged. The end frame of the coupling is connected to this rotary-support frame by means of separate screws and the end frame of the coupling included the inlet connection for steam and the outlet connection for condensate. This construction has proven to be problematic.

It is another object of the present invention to provide a new and improved steam and condensate coupling, in particular, for use in a drying cylinder of a paper or board machine.

In order to achieve these objects, and others, in the construction in accordance with the invention, the frame of the steam and condensate coupling consists of one single cast piece, which comprises an outlet connection for condensate or both an outlet connection for condensate and an inlet connection for steam. Further, the frame in accordance with the invention comprises an annular groove which operates as a sort of a cylinder for the piston part to be situated in the groove, to which piston part a carbon seal or equivalent is attached In view of this unique combination of elements, it has been possible to simplify the construction of a steam, condensate or water coupling quite considerably. The construction in accordance with the present invention is a modular part, in which the same basic construction can be used in all steam supply and condensate removing devices provided with a standing syphon irrespective of the machine speed, paper/board grade, or pressure category. The coupling in accordance with the invention is also suitable for use as a water coupling for such modes of operation of a cylinder in which cooling water is passed into the interior of the cylinder so as to cool the cylinder and in which construction compressed air is passed into the cylinder so as to remove the water through an exhaust pipe, preferably a condensate pipe, under pressure out of the interior of the cylinder. The construction in accordance with the invention is also suitable for such embodiments of a condensate removing coupling in which steam is passed into the interior of the cylinder from one end of the cylinder and in which condensate is removed through a coupling in accordance with the invention from the opposite end of the cylinder. Thus, in such a case, the coupling construction comprises just a condensate pipe for removal of water and condensate through a construction in accordance with the invention.

In one embodiment of the invention, the coupling is used for cylinder in a paper/board machine which keeps an interior of the cylinder pressure-tight while permitting rotation of the cylinder. The cylinder has a stationary pipe system leading into the interior of the cylinder through an interior space in a shaft of the cylinder and a bearing housing for supporting the shaft. The coupling frame in accordance with the invention is arranged in connection with an end of the cylinder and includes an exhaust connection coupled to the stationary pipe system and through which condensate or water is removed from the interior of the cylinder, an annular groove, and at least one spring socket. The coupling also includes a piston arranged in the annular groove of the coupling frame and at least one spring arranged in a respective spring socket for pressing the piston against the shaft of the cylinder, each spring being arranged between the piston and a face of the respective spring socket. The coupling is fixed by fastening means to the bearing housing. At times, the piston may include a seal member for providing a seal between the piston and the shaft of the cylinder. The coupling frame may be an integral cast piece or cast from iron so that it constitutes a single piece of cast iron.

In certain embodiments, the coupling frame includes a flange part whereby the fastening means are arranged in connection therewith for directly connecting the coupling frame to one of the bearing housings of the cylinder. As such, the fastening means comprise at least one hole in the flange part and a fastening bolt or screw extending through each hole into engagement with the associated bearing housing of the cylinder. The coupling may also include connecting means for connecting the seal member to the piston, e.g., an annular rib contacting a shoulder of the seal member and screws passing through a respective aperture in the annular rib and into connection with the piston. A U-section or V-section seal ring may be interposed between a face of the seal member situated in opposed relationship to the piston and a face of the piston situated in opposed relationship to the seal member, and rotation prevention means provided for preventing rotation of the piston relative to the coupling frame. In this regard, the rotation prevention means may comprise a key arranged in a hole in the frame and at least partially in an aligned hole in the piston.

The arrangement for a drying cylinder in a paper/board machine in accordance with the invention comprises a stationary steam and condensate coupling including a steam pipe structured and arranged to pass steam into an interior of the drying cylinder, a condensate pipe structured and arranged to remove condensate from the interior of the drying cylinder, and a coupling frame arranged in connection with an end of the cylinder. The coupling frame includes an exhaust connection coupled to the condensate pipe, an annular groove arranged in a face of the coupling frame facing toward the drying cylinder, and at least one spring socket opening into the annular groove. The arrangement also includes a revolving axle arranged at one end of the drying cylinder, the steam and condensate pipes being passed through the axle, a bearing housing for rotatably supporting the axle, a piston arranged in the annular groove of the coupling frame, at least one spring arranged in a respective spring socket to press the piston against a portion of the axle, each spring being arranged between the piston and a face of the respective spring socket, and fastening means for fixing the coupling frame to the bearing housing.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figures 1A, 1B, 1C:
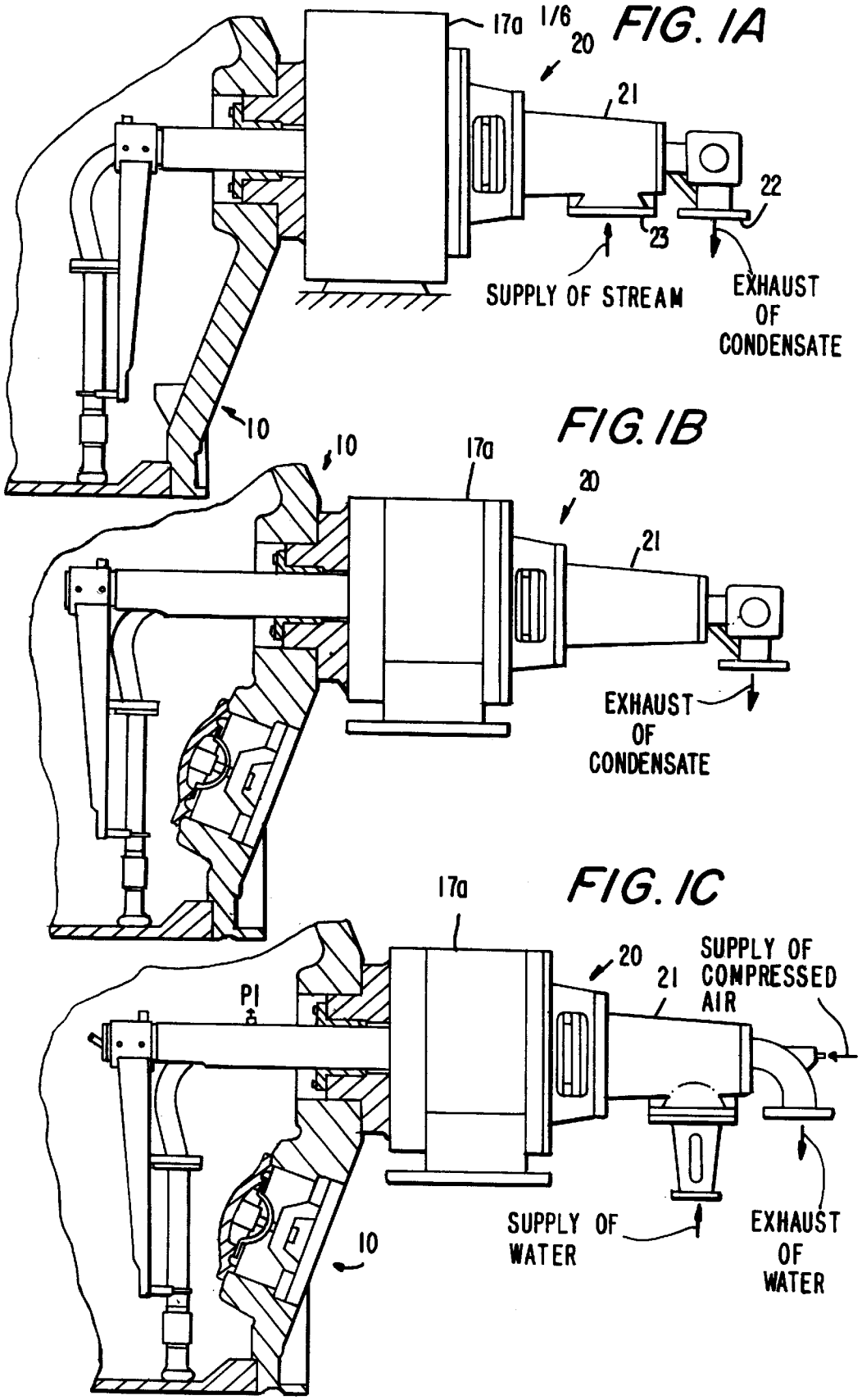
FIG. 1A shows a coupling in accordance with the invention in connection with a drying cylinder in a paper machine whereby in order to heat the drying cylinder, steam is introduced through the coupling, and the condensed steam and the condensate are removed from the interior of the drying cylinder through a syphon pipe and a condensate pipe and through the coupling in accordance with the invention.
FIG. 1B shows an embodiment of the invention in which the coupling is operated so that the condensate is removed exclusively through the coupling and whereby steam is passed into the interior of the cylinder through the opposite end of the cylinder.
FIG. 1C shows an embodiment of the invention in which the coupling is used as a water coupling, in which case the cooling water for the cylinder is passed through the coupling, and compressed air is passed into the cylinder through a compressed-air connection mounted in the condensate pipe and water is removed out of the interior of the cylinder.
Figure 2A:
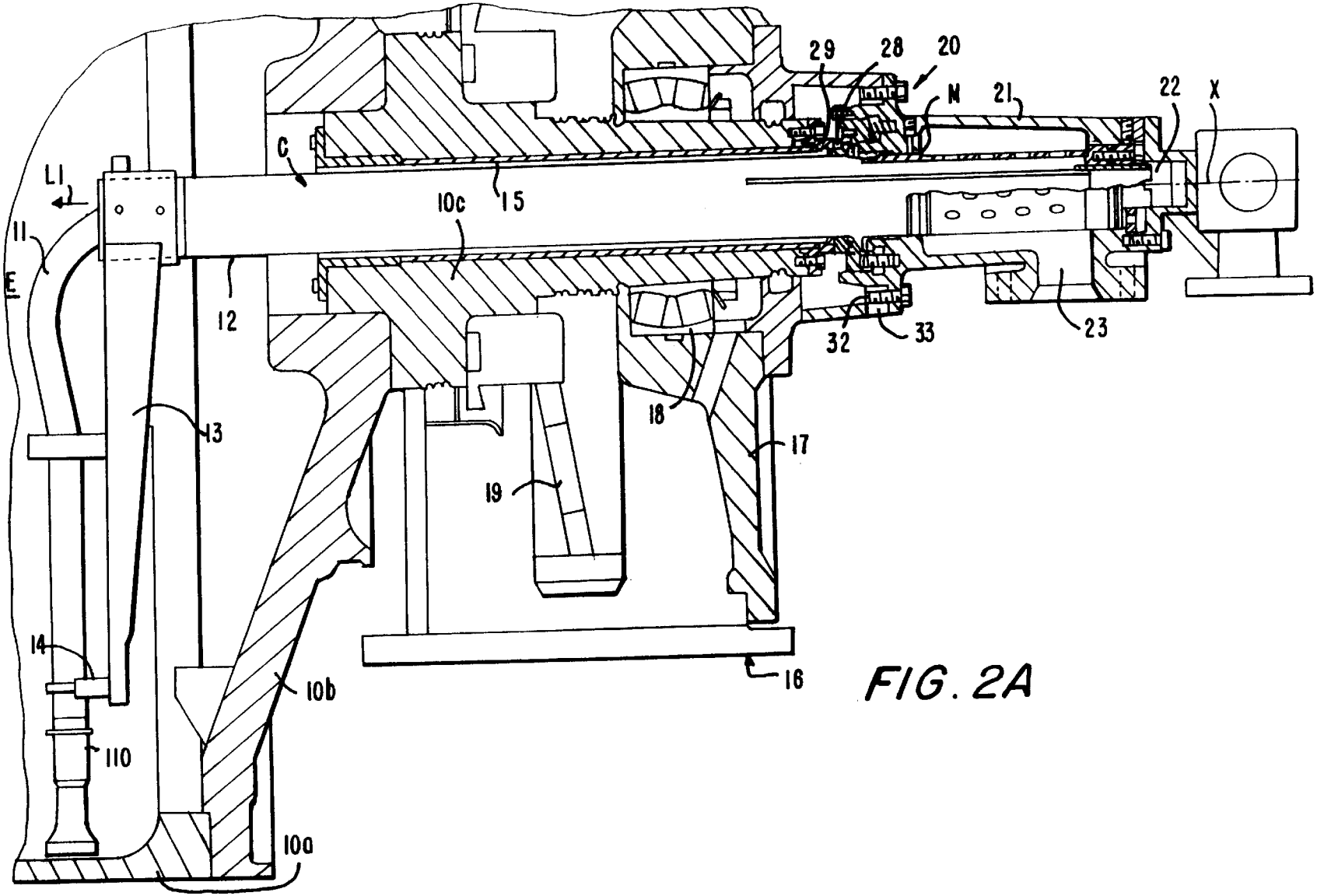
FIG. 2A is a longitudinal sectional view and an illustration in part of a cylinder and coupling construction in accordance with the invention.

Referring to the accompanying drawings wherein the same reference numerals refer to the same or similar elements, FIG. 1A shows a drying cylinder 10 of a paper machine or a board machine, which cylinder is rotated on support of bearing means 17*a* and into which steam is supplied through an opening 23 in a side face of a frame 21 of a steam/condensate/water coupling 20 in accordance with the invention. Condensate formed in the interior of the drying cylinder 10 is removed from the end of the frame 21 through an opening 22. In its connection, the frame 21 comprises a piston 25 and a seal 28 arranged in association with the piston 25 and operatively pressed against an annular part 29 (and will be described below in greater detail with reference to FIGS. 2A–2E). Seal 28 may be a ceramic seal ring. Part 29 is placed at the end of the rotated shaft 10*c* (FIG. 2A). The drying cylinder is rotated by suitable rotation means, for example, by the intermediate of a gear wheel 19 (FIG. 2A) by means of a motor, or the drying cylinder may be freely revolving.

FIG. 1B shows an embodiment of the invention in which the coupling 20 in accordance with the invention is used for removal of condensate only. The steam is passed into the interior of the drying cylinder 10 through the opposite end of the drying cylinder 10 (not shown in the drawing) centrally through the shaft, and the condensate is removed through the end of the frame 21 of the coupling 20 in accordance with the invention. Thus, the steam enters the interior of the drying cylinder through one end and condensate is removed from the opposite end.

FIG. 1C shows an embodiment of the invention in which the coupling in accordance with the invention is used as a water coupling for supplying water into the interior of the cylinder 10. In this manner, the cylinder 10 operates as a cooling cylinder. The cooling water is introduced through the frame 21 of the coupling 20 (through a so-called steam connection) and is passed into the interior of the cylinder. The water is removed through the condensate pipe. Along a separate duct, compressed air is passed into the cylinder, and the water is removed through the condensate pipe by means of the air pressure provided inside the cylinder.

From the foregoing, it can be appreciated that the coupling construction in accordance with the invention can be used for the passage of steam into the cylinder or the passage of steam into the cylinder and the removal of condensate from the cylinder or the passage of water into the cylinder and the removal of water therefrom. The most significant change in these embodiments is the component in the central cavity of the support shaft of the cylinder, i.e., a steam pipe or condensate pipe or water pipe. However, the general construction of the coupling construction described below can be used in connection with all of these different steam/water/condensate embodiments.

Figure 2B:
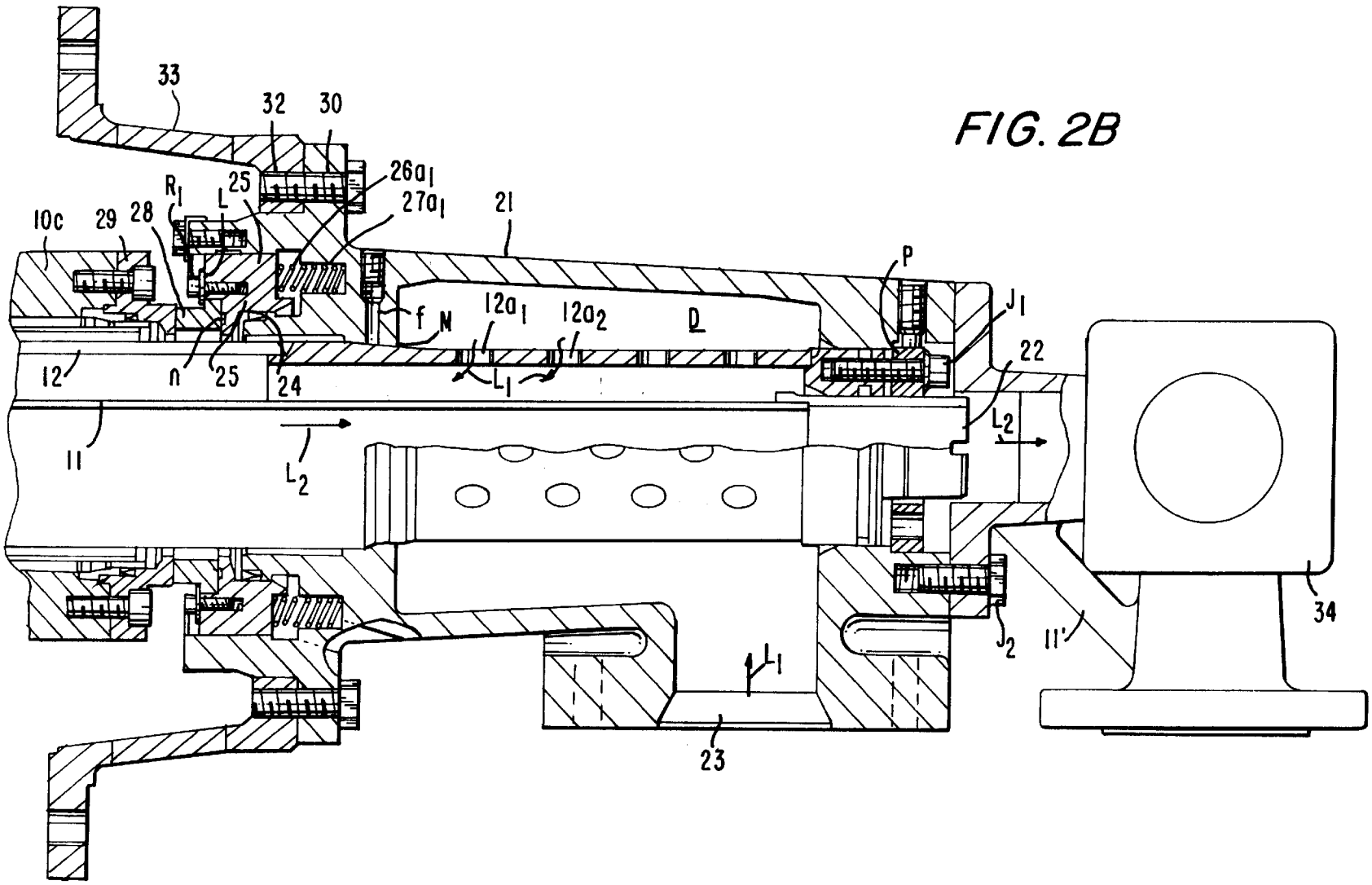
FIG. 2B shows the coupling construction in accordance with the invention on an enlarged scale.

FIG. 2A is a longitudinal sectional view and an illustration in part of a steam/condensate coupling construction in accordance with the invention. FIG. 2B shows the coupling construction in an enlarged view. As shown in FIGS. 2A and 2B, the drying cylinder 10 of a paper/board machine comprises a mantle 1O*a* and a related end flange 10*b,* which is further connected with a shaft 10*c* which includes a hollow interior space C.

In the manner indicated by the arrow $L_1$, the steam is passed through the steam pipe 12, along the flow duct placed between the steam pipe 12 and the condensate pipe 11 passing in its interior, into the space E in the interior of the cylinder 10. The condensate pipe 11 is arranged in the interior of the steam pipe 12 and they may be coaxial with one another. After having delivered its heat to the interior of the drying cylinder 10 and specifically to the inner surface of the mantle 1O*a* of the drying cylinder 10, the steam condenses, and the condensate is removed through a syphon pipe 110 connected with the condensate pipe 11 and drawn through the condensate pipe 11 out of the interior of the cylinder 10. The steam pipe 12 is supported on the syphon pipe 110 by means of a support 13 and by means of fastenings 14. Other syphon pipe support structure can also be used without deviating from the scope and spirit of the invention. The steam pipe 12, and the condensate pipe 11 placed in its interior, are passed into the interior of the cylinder 10 through the hollow interior space C in the shaft 10*c* of the cylinder 10. Between the steam pipe 12 and the hollow interior space in the shaft 10*c,* there is additionally a shield pipe 15.

The gear housing 16 which supports shaft 10*c* of the cylinder 10 comprises a bearing housing 17 connected with the gear housing 16 and bearing means 18 arranged in the bearing housing 16, and the cylinder 10 is rotated on support of the bearing means 16 cooperating with the shaft 10*c*. Further, in the interior of the gear housing 16, there is a gear wheel 19 connected with the shaft 10*c,* the rotation drive (not shown) being passed or conveyed to the gear wheel 19 so as to rotate the cylinder 10 through rotation of its shaft 10*c*.

As shown in FIGS. 2A and 2B, according to the invention, the steam/condensate coupling 20 comprises a frame 21, which is a cast piece, preferably a single piece of cast iron. The frame 21 comprises a rear frame portion 21*a* having an interior in which a steam inlet chamber D is formed (FIG. 1C). A forward frame portion 21*b* of the frame 21 forms the coupling construction proper, and includes an annular space 24 receivable of a piston 25. The piston 25 moves in the annular space 24. The piston 25 is further connected with the seal 28, which is preferably a carbon seal, which is placed against the revolving shaft 10*c* or against the part 29 connected with the shaft 10*c*. Further, the frame 21 comprises a fastening portion 21*c,* which is preferably a flange-like part, which includes one or more fastening holes 30 for passing respective fastening screws 31 into a separate fastening rib 33, and specifically into its threaded holes 32. The fastening rib 33 can be, for example, a constructional piece directly connected with the bearing housing 17 and made of one cast piece with the bearing housing 17, or it can be a separate constructional part which can be connected with the bearing housing 17. Other fastening means for securely attaching the frame 21 to the bearing housing 17 or an extension thereof can be used in accordance with the invention.

According to the invention, the frame 21 is a unified cast frame, preferably made of cast iron. In the interior of its rear frame portion 21*a,* the inlet chamber D has been formed for steam. The inlet chamber is a wide chamber space through which the steam pipe 12 is passed, and fluidly connected therewith, and into which bores $12a_1$, $12a_2$ . . . or equivalent conduits provided in the steam pipe 12 are opened, the steam being passed out of the space D through the bores or equivalent conduits, in the manner indicated by the arrows $L_1$, into the interior of the steam pipe 12 (FIG. 2B). The condensate pipe 11 extends through the space D but does not open therein.

The steam pipe 12 is connected with the end of the frame part 21 and further, by means of a wedge joint, with a conical hole M in the frame 21 at the forward side of the chamber D. A duct 36 opens into the conical hole M and through the duct, pressurized oil may be passed to the vicinity of the conical face during disengagement of the steam pipe 12 from the coupling frame 21. The frame part 21 further comprises an inlet opening 23 for the intake of steam, which opening is opened into the space D and is placed at the side of or in a side face of the frame portion 21*a*. At the end of the frame portion 21*a,* there is an exhaust opening 22 for passing the condensate through the opening and out of connection with the frame, preferably through a flow clock 34 or through an equivalent indicator that indicates the flow. The steam pipe 12 is connected by means of fastening means such as screws $j_1$ with a fastening plate P connected with the frame 21. The condensate exhaust pipe 11' is connected with the frame 21 by means of fastening means such as screws $j_2$. The inner bore in the plate P also operates as a fastening support face, either directly or by the intermediate of the steam pipe, for the end of the condensate pipe 11.

Figure 2C:
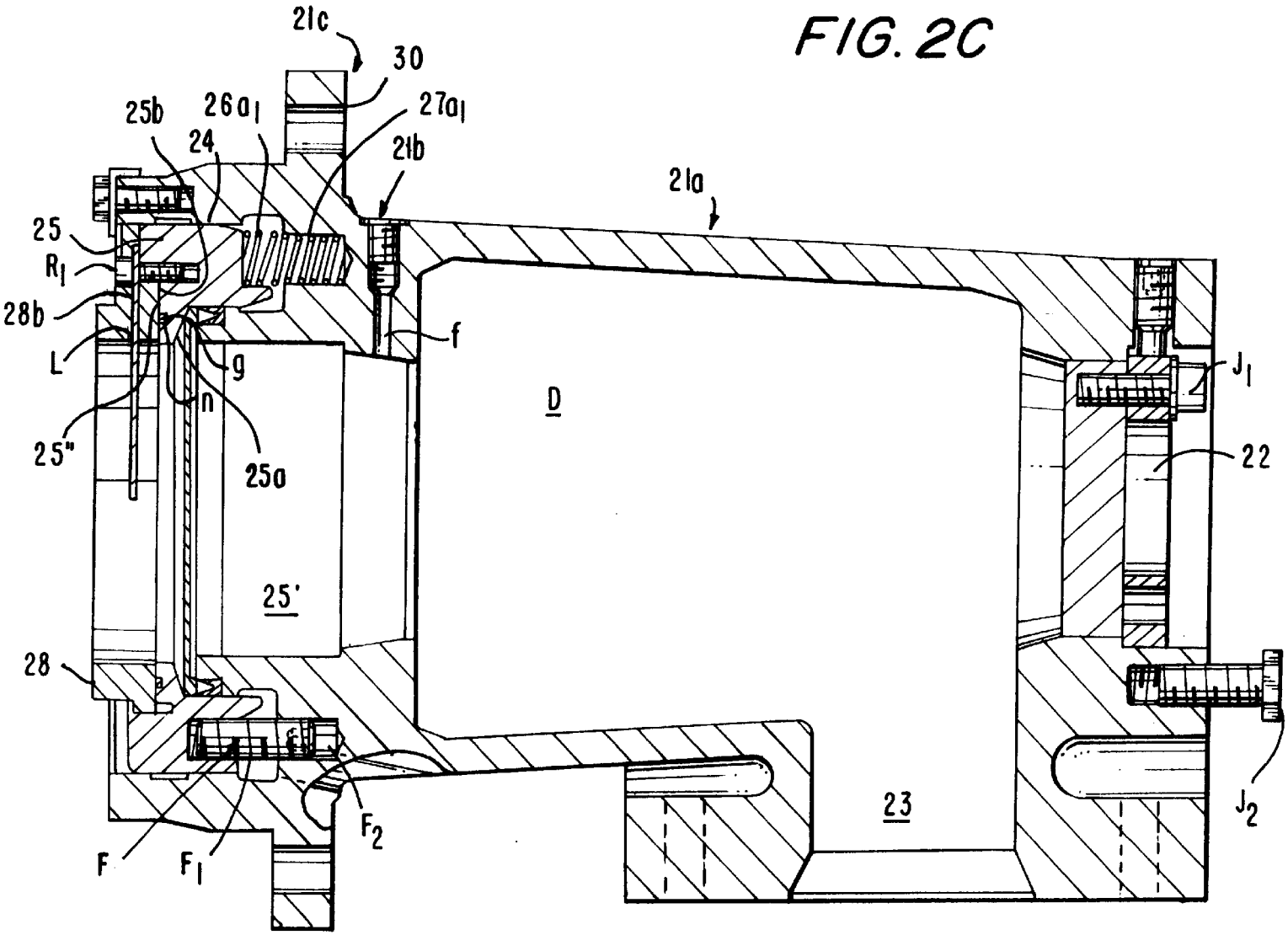
FIG. 2C is a separate illustration of a coupling construction in accordance with the invention with the steam and condensate pipes removed.

FIG. 2C is a separate illustration showing the frame 21 of the steam/condensate coupling in accordance with the invention, which frame is preferably a cast part. The frame 21 comprises a rear frame portion 21*a* and a forward frame portion 21*b*, in whose annular space 24, the piston 25 can be fitted. Springs $26a_1$,$26a_2$ . . . are placed in spring sockets $27a_1$,$27a_2$ . . . in the frame, which sockets have been divided uniformly around a circle, preferably as evenly spaced, i.e., uniformly, circumferentially spaced about the face of the coupling frame 21 facing the axle or shaft lO*c* of the cylinder 10. The piston 25 comprises a face 25*a* inclined in relation to the longitudinal axis (X), upon which face 25*a* the steam pressure present inside the steam cylinder 10 is fitted to act. As such, the piston 25 is pressed against the end of the rotated shaft 10*a* or against a part 29 connected with the shaft 10*a*. In this way, rotation of the cylinder 10 is permitted while the pressurized steam cannot be discharged out of the interior space E in the cylinder 10. The stationary steam and condensate pipes 12,11 can, however, in this construction, be passed into the cylinder 10 from outside the cylinder 10.

The seal 28 is connected with the piston 25 by means of the screws $R_1$,$R_2$, . . . while an annular plate L keeps the seal 28 in a recess 25*b* in the piston. The seal 28 comprises a shoulder 28*b,* which is placed behind the rib L when the rib L is placed in its position on the piston 25 by means of the screws $R_1$, $R_2$, . . .

As shown in FIG. 2C, rotation of the piston 25 is prevented by means of a key F. The key F is fitted into a threaded hole $F_2$ in the frame 21 with a threading and into a hole $F_1$ in the piston 25 with a glide fitting. In this manner, gliding of the piston 25 in the direction of the X-axis is permitted. The key F is placed in the hole $F_1$ in a front face 25' of the piston 25 and in the hole $F_2$ in the frame 21. A separate seal ring n is placed between the seal 28 and the piston 25 in a ring groove g. The sectional shape of the seal n provided with a spring ring is preferably V-section or U-section, in which case the steam pressure can act upon the interior of the seal n if the pressure has access to the seal. The pressure is effective in the interior of the seal, and the seal n is pressed further against the carbon seal 28 or equivalent. In this manner, access of steam beyond the seal n is also prevented in situations in which the seal 28 proper, preferably a carbon seal, is worn.

Figure 2D:
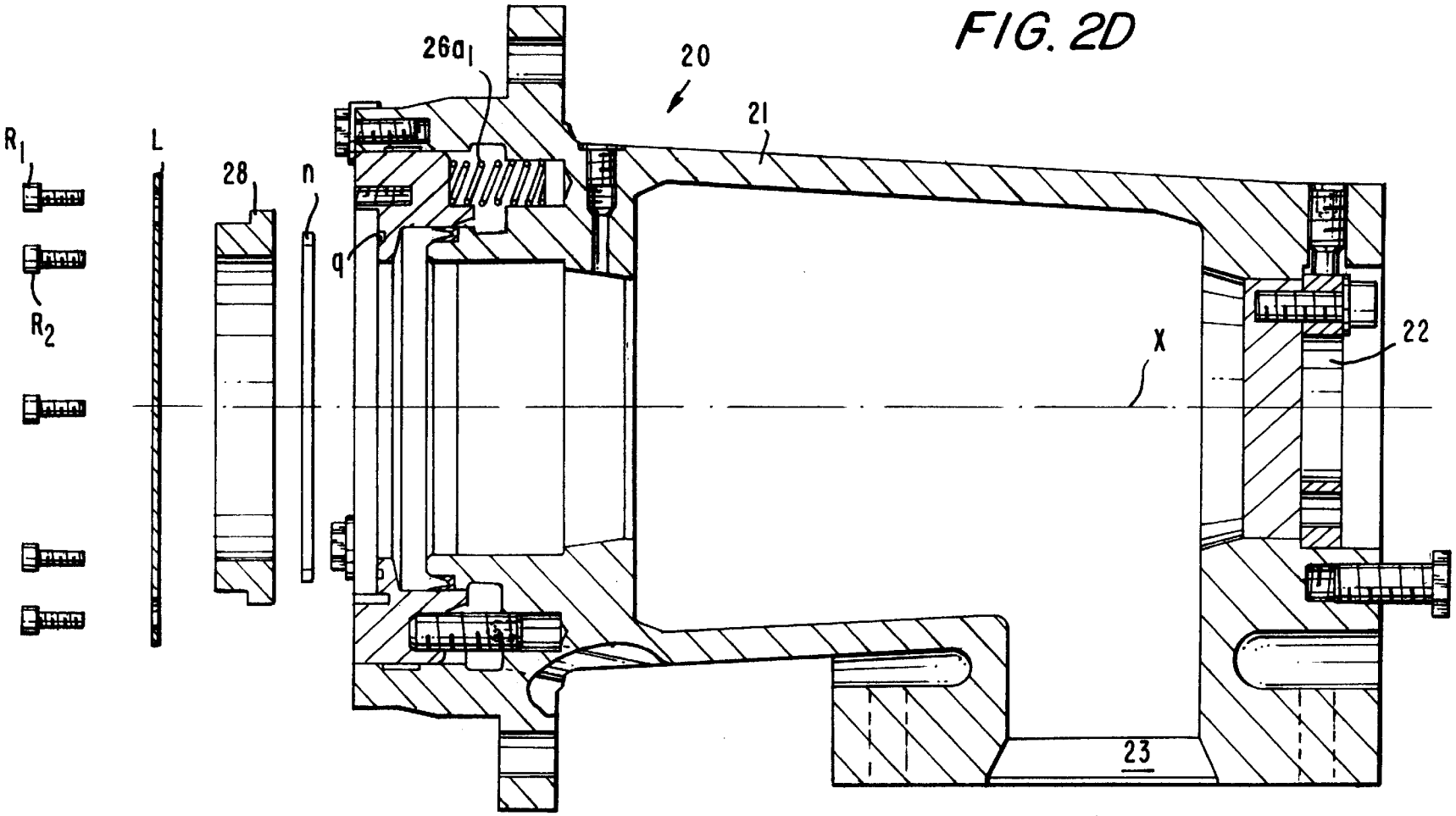
FIG. 2D is an exploded view of the seal of the coupling construction shown in FIG. 2C as taken apart from the rest of the construction.

FIG. 2D shows the seal 28 unassembled and separate from the rest of the construction and with the steam and condensate pipes 11 and 12 removed. By means of the screws $R_1$,$R_2$, the annular rib L, is placed against the shoulder 28*b* of the seal 28. The seal n is fitted into the annular space g provided in the piston 25. Then, the seal n is placed between the piston 25 and the bottom of the seal 28.

Figure 2E:
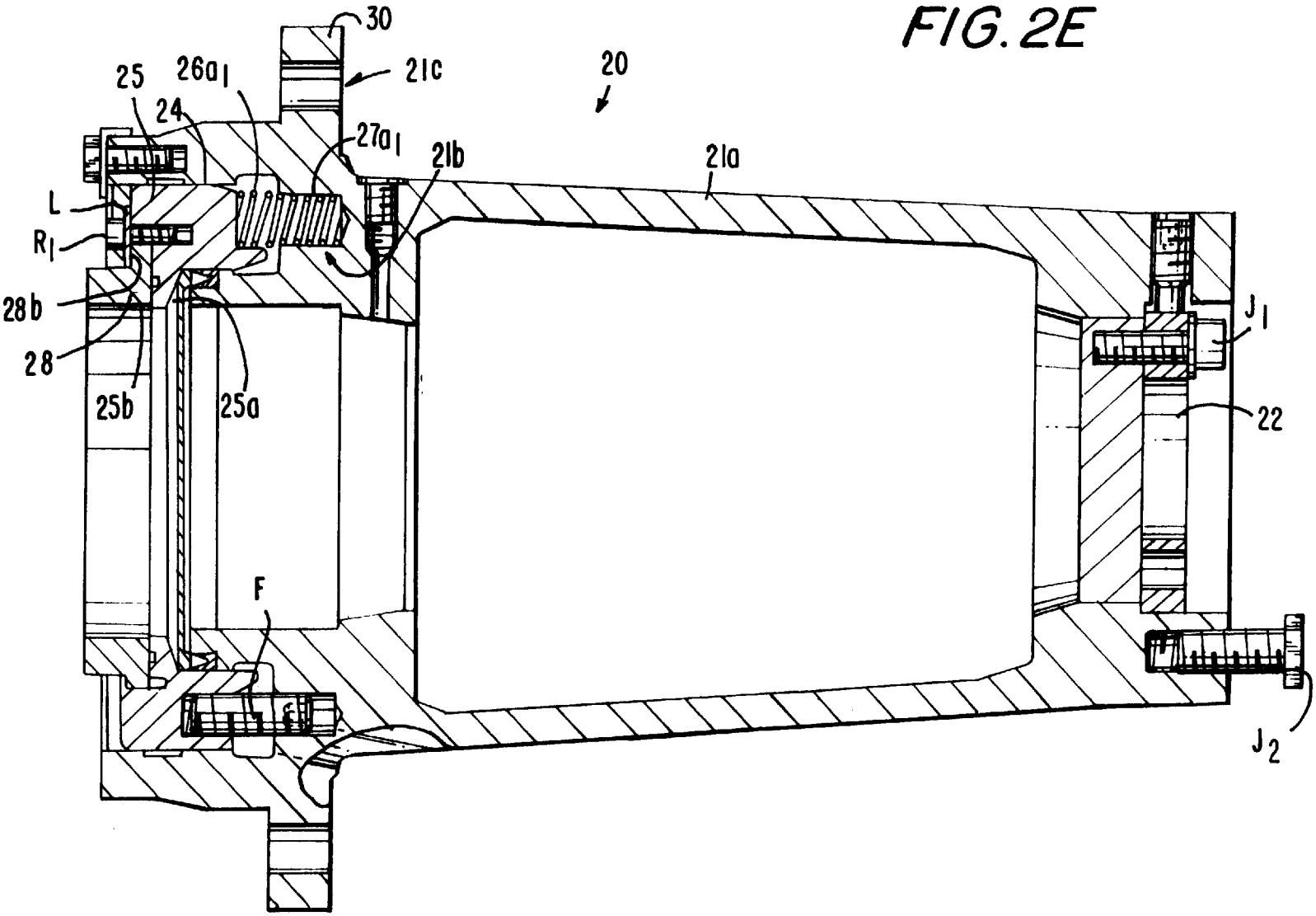
FIG. 2E shows an embodiment of the invention in which the coupling frame comprises an exhaust connection for condensate only in which case, the coupling frame is suitable for embodiments in which only condensate is removed through the coupling, while the steam is passed into the cylinder from the opposite end of the cylinder.

FIG. 2E shows an embodiment of the invention which is suitable for applications of removal of condensate only. In this embodiment, a frame 210 comprises exclusively an outlet opening 22 for the condensate pipe 11. Steam is not passed through the frame 210 into the interior E of the cylinder 10. Rather, the steam is passed into the interior E of the cylinder 10 from one end of the cylinder 10, and the condensate is removed through the frame 21 shown in FIG. 2C through the opposite end of the cylinder 10.

The examples provided above are not meant to be exclusive. Many other variations of the present invention would be obvious to those skilled in the art, and are contemplated to be within the scope of the appended claims.

I claim:

1. A coupling for a cylinder in a paper/board machine which keeps an interior of the cylinder pressure-tight while permitting rotation of the cylinder, the cylinder having a stationary pipe system leading into the interior of the cylinder through an interior space in a shaft of the cylinder and a bearing housing for supporting the shaft, comprising a unitary coupling frame arranged in connection with an end of the cylinder, said coupling frame including an exhaust connection coupled to the stationary pipe system and through which condensate or water is removed from the interior of the cylinder, an annular groove, and at least one spring socket, a piston arranged in said annular groove of said coupling frame, at least one spring arranged in a respective one of said at least one spring socket of said coupling frame to press said piston against the shaft of the cylinder, each of said at least one spring being arranged between said piston and a face of the respective one of said at least one spring socket, and fastening means for fixing said coupling frame to the bearing housing.

2. The coupling of claim 1, wherein said piston include a seal member for providing a seal between said piston and the shaft of the cylinder.

3. The coupling of claim 1, wherein said coupling frame is an integral cast piece.

4. The coupling of claim 1, wherein said coupling frame is cast from iron so that it constitutes a single piece of cast iron.

5. The coupling of claim 1, wherein said coupling frame further comprises means defining a steam inlet chamber in an interior of said coupling frame, an inlet opening for passing steam into said steam inlet chamber, a conical hole adapted to engage with a steam pipe of the stationary pipe system such that the steam pipe is fixable to said coupling frame by wedging against said conical hole, a condensate pipe of the stationary pipe system being passable centrally through the steam pipe whereby steam is passed into the interior of the cylinder through a flow duct placed between the steam pipe and the condensate pipe.

6. The coupling of claim 5, further comprising a duct opening into said conical hole and through which pressurized oil is passed to the vicinity of said conical face during disengagement of the steam pipe from said coupling frame.

7. The coupling of claim 1, wherein the cylinder is supported by bearing housings, said coupling frame including a flange part, said fastening means being arranged in connection with said flange part for directly connecting said coupling frame to one of the bearing housings of the cylinder.

8. The coupling of claim 7, wherein said fastening means comprise at least one hole in said flange part and a fastening bolt or screw extending through each of said at least one hole into engagement with the associated bearing housing of the cylinder.

9. The coupling of claim 2, wherein said seal member has a shoulder, further comprising connecting means for connecting said seal member to said piston, said connecting means comprising an annular rib contacting said shoulder of said seal member and screws passing through a respective aperture in said annular rib and into connection with said piston, a U-section or V-section seal ring interposed between a face of said seal member situated in opposed relationship to said piston and a face of said piston situated in opposed relationship to said seal member, and rotation prevention means for preventing rotation of said piston relative to said coupling frame.

10. The coupling of claim 9, wherein said coupling frame includes a hole and said piston includes a hole aligned with said hole in said frame, said rotation prevention means comprising a key arranged in said hole in said frame and at least partially in said hole in said piston.

11. The coupling of claim 1, wherein said at least one spring socket comprises a plurality of spring sockets spaced uniformly, circumferentially around said coupling frame 1.

* * * * *